US009597903B1

(12) United States Patent
Hsu

(10) Patent No.: US 9,597,903 B1
(45) Date of Patent: Mar. 21, 2017

(54) PRINTER

(71) Applicant: WISTRON CORP., New Taipei (TW)

(72) Inventor: Sheng-Chia Hsu, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 15/204,856

(22) Filed: Jul. 7, 2016

(30) Foreign Application Priority Data

Mar. 25, 2016 (TW) ..... 105109439 A

(51) Int. Cl.
*B41J 2/32* (2006.01)
*B41J 15/04* (2006.01)

(52) U.S. Cl.
CPC *B41J 15/04* (2013.01); *B41J 2/32* (2013.01)

(58) Field of Classification Search
CPC . B41J 29/393; B41J 29/38; B41J 29/02; B41J 11/42; B41J 13/02; B41J 2/04505
See application file for complete search history.

(56) References Cited

U.S. PATENT DOCUMENTS 7,540,597 B2 * 6/2009 Guhse ..... B41J 2/17506 347/84
7,984,871 B2 * 7/2011 Nagata ..... B41J 11/0095 242/413.3
9,308,760 B2 * 4/2016 Kasuga ..... B41J 29/38

* cited by examiner

*Primary Examiner* — Lamson Nguyen
(74) *Attorney, Agent, or Firm* — Maschoff Brennan

(57) ABSTRACT

A printer is for accommodating paper roll and includes main body, cover, first printing set and detecting module. The main body has an accommodating space and a shaft located in the accommodating space. The cover is pivoted to the main body. The first printing set is disposed in the main body. The detecting module includes a switch and a flexible member being disposed close to the switch and having a fixed section and a movable section which are opposite to each other. The movable section is movably located between the paper inlet and the paper roll. When the movable section is pressed by the paper sheet and moved toward the switch, the movable section presses against the switch. When the movable section of the flexible member is not being pressed by the paper sheet, the movable section is located in a first detecting area.

16 Claims, 6 Drawing Sheets

PRINTER

CROSS-REFERENCE TO RELATED APPLICATIONS

This non-provisional application claims priority under 35 U.S.C. §119(a) on Patent Application No(s). 105109439 filed in Taiwan, R.O.C. on Mar. 25, 2016, the entire contents of which are hereby incorporated by reference.

TECHNICAL FIELD

The disclosure relates to a printer, more particularly to a printer for a roll of printing paper which is required to be correctly installed in the printer.

BACKGROUND

Thermal paper is used in thermal printers and particularly in devices such as fax machines, cash registers, and credit card terminals. It is a special fine paper that is coated with one or more chemical substances that change color when exposed to heat. For example, when the thermal paper passes over a thermal print head of the thermal printer, the coating changes its color in the areas where it is heated, thereby producing images.

For correctly installing the thermal paper roll, the thermal paper roll should be placed in a predetermined direction so that the surface of the thermal paper roll coated with the chemical substances can face the thermal print head for producing images. Thus, when the thermal paper roll is installed backward, the thermal print head is not able to produce images on the surface of the thermal paper roll. However, the traditional printers have no any warning system for warning the incorrect installation of the thermal paper roll, so users often install the thermal paper roll incorrectly without notice. When the printer is operated, and the thermal paper roll is installed incorrectly, some of the thermal paper sheet would be wasted, and the user would be confused by that. For example, when a checkout staff uses the cash register to print out a receipt without noticing the incorrect installation of the thermal paper roll, some of the paper roll is wasted, and the checkout staff has to reinstall the thermal paper roll and then to rescan products. Accordingly, developers constantly try to solve the problem that the user often operates the printer while the thermal paper roll is installed incorrectly.

SUMMARY

The present disclosure provides a printer for solving the problem that the printer is often operated while the thermal paper roll is installed in the printer incorrectly.

One embodiment of the disclosure provides a printer configured for accommodating a paper roll formed by rolling a paper sheet. The printer includes a main body, a cover, a first printing set and a detecting module. The main body has an accommodating space and a shaft. The accommodating space is configured for accommodating the paper roll. The shaft is located in the accommodating space and configured for installation of the paper roll. The cover is pivoted to the main body for covering the accommodating space or leaving the accommodating space exposed. The first printing set is disposed in the main body. The detecting module includes a switch and a flexible member. The switch is disposed in the accommodating space. The flexible member has a fixed section and a movable section which are opposite to each other. The fixed section is disposed close to the switch. The movable section is movably located between the paper inlet and the paper roll. When the movable section is pressed by the paper sheet of the paper roll and moved toward the switch, the movable section of the flexible member presses against the switch. The paper channel is configured for the paper sheet to pass through. When the paper roll is full, a first paper feeding angle of the paper roll is $\theta 1$. When the paper roll is used up, a second paper feeding angle of the paper roll is $\theta 2$. The following condition is satisfied: $\theta 1 > \theta 2$. A vertical distance between the movable section and the paper inlet of the paper channel is D. There is a first detecting area having two first sides which are opposite to each other, and each of the two first sides is parallel to a reference line which is simultaneously passing through the paper inlet of the paper channel and a shaft axis of the shaft. A distance from the reference line to each of the two first sides is equal to $D \times \tan \theta 1$. When the movable section of the flexible member is not being pressed by the paper sheet, the movable section is located in the first detecting area. The symbol "×" means the multiplication sign.

Another embodiment of the disclosure provides a printer configured for accommodating a paper roll formed by rolling a paper sheet. The printer includes a main body, a printing assembly and a detecting module. The main body has an accommodating space and a shaft. The accommodating space is configured for accommodating the paper roll. The shaft is located in the accommodating space and configured for installation of the paper roll. The printing assembly is disposed on the main body. The printing assembly has a paper channel. The paper channel has a paper inlet and a paper outlet which are opposite to each other. The paper inlet is connected to the paper outlet. The switch is disposed in the accommodating space and close to the printing assembly. The flexible member has a fixed section and a movable section which are opposite to each other. The fixed section is disposed in the accommodating space and close to the switch. The movable section movably is located between the paper inlet and the paper roll. When the movable section is forced by a section of the paper sheet passing through the paper inlet to move through a predetermined position, the movable section of the flexible member presses against the switch so that the switch transmits a signal representing that the paper roll is disposed on the shaft correctly or incorrectly.

According to the printer as discussed above, the switch of the detecting module and the flexible member are located in the accommodating space, and the movable section of the flexible member is located in the first detecting area or the second detecting area in which the paper sheet of the paper roll passes through; thus, before operating the printer, the correctness of the installation of the paper roll can be detected by the flexible member and the switch. Therefore, the printer is prevented from operating while the paper roll is installed incorrectly.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

Figure 1:
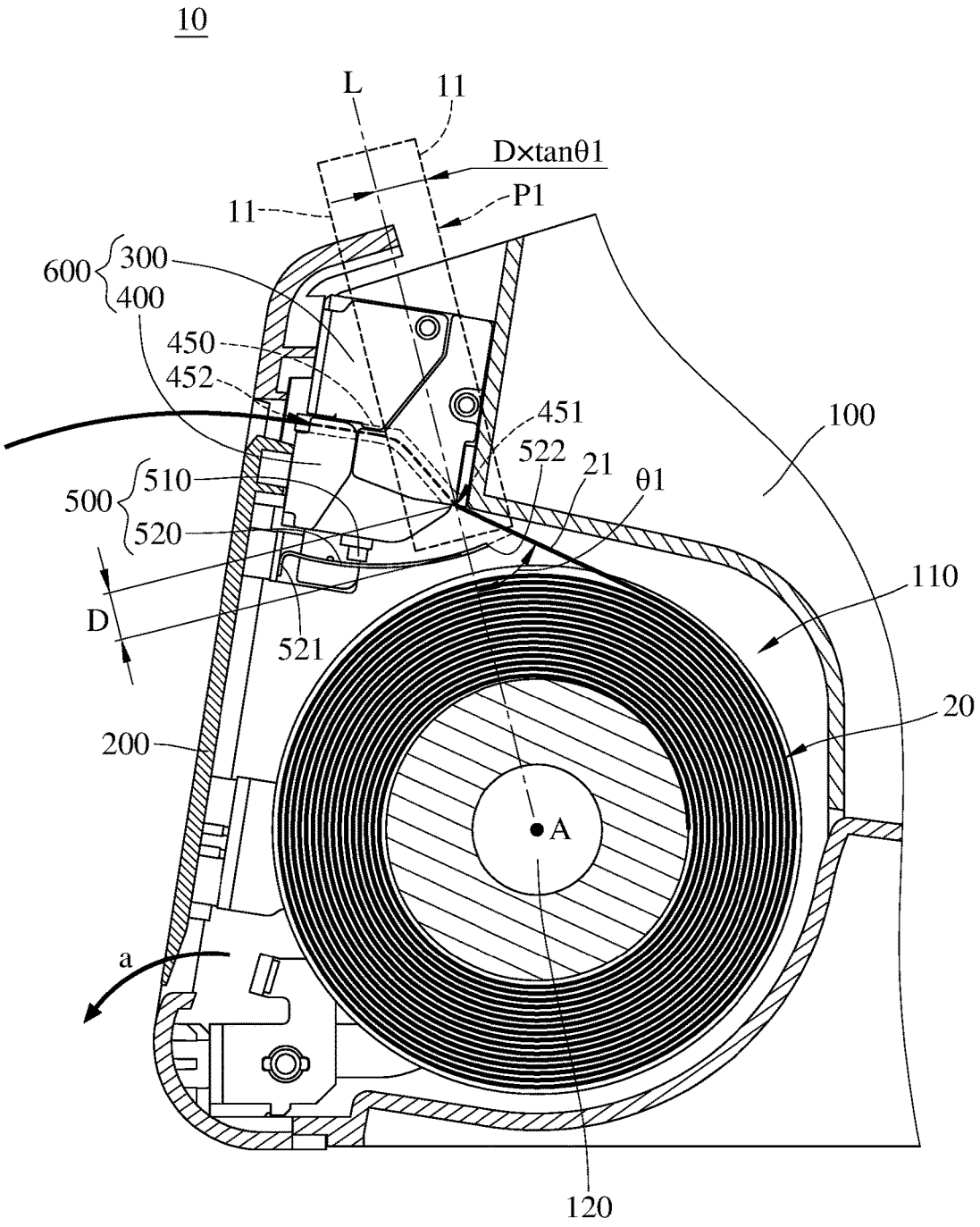
FIG. 1 is a cross-sectional view of a printer having a paper roll which is full and installed correctly according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
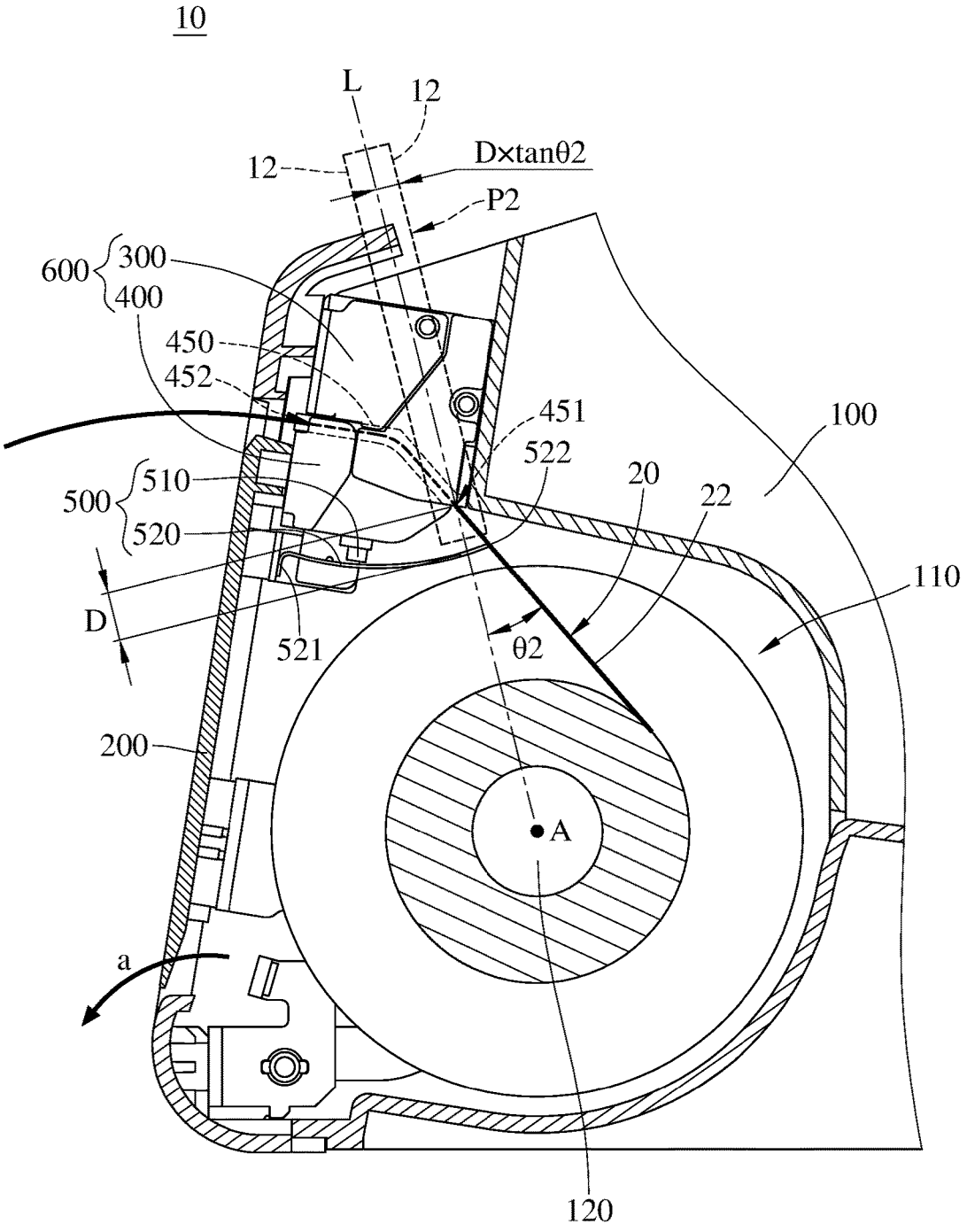
FIG. 2 is a cross-sectional view of the printer having a paper roll which is used up and installed correctly according to the first embodiment of the disclosure.
Figure 3:
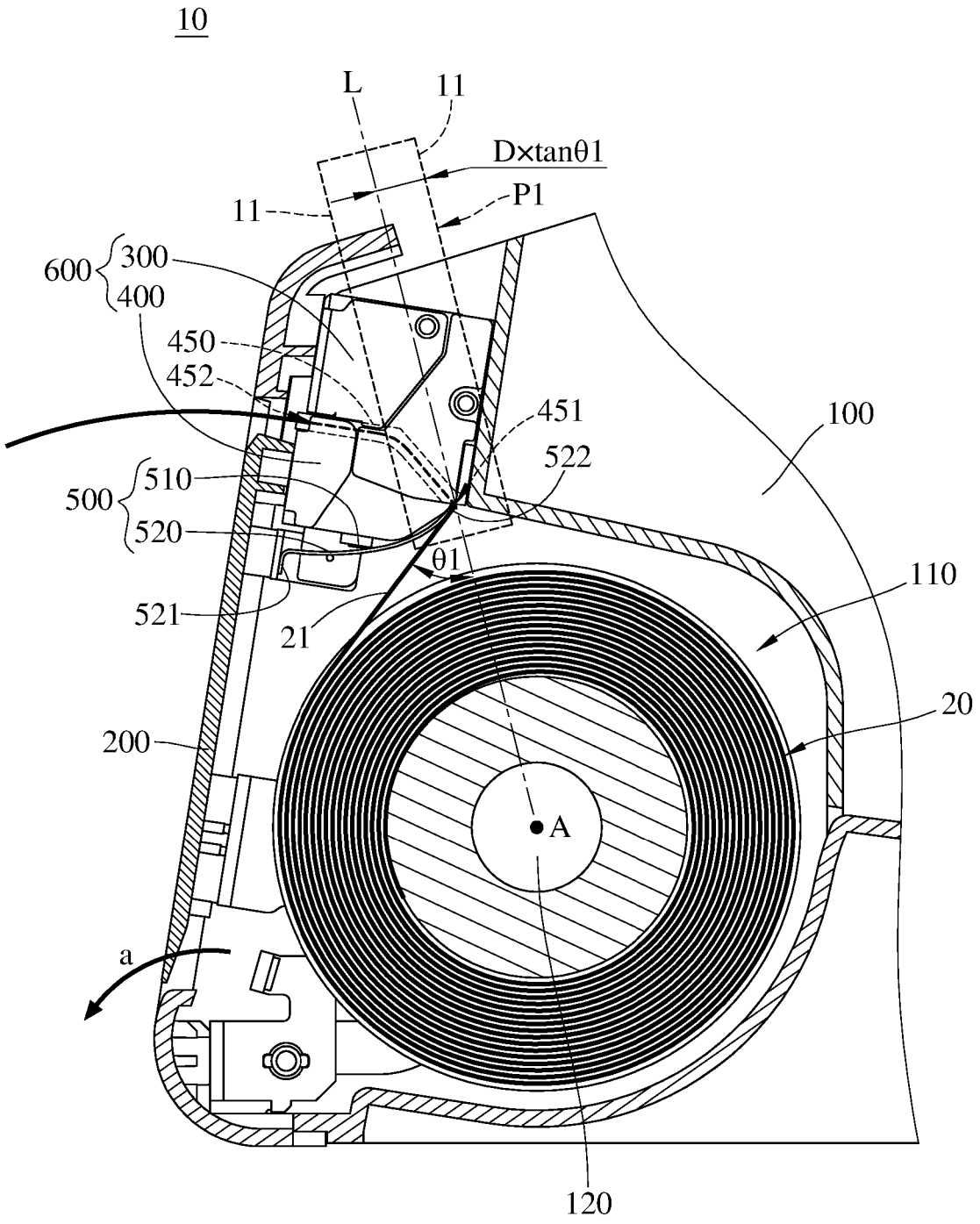
FIG. 3 is a cross-sectional view the printer having the paper roll which is full and installed incorrectly according to the first embodiment of the disclosure.
Figure 4:
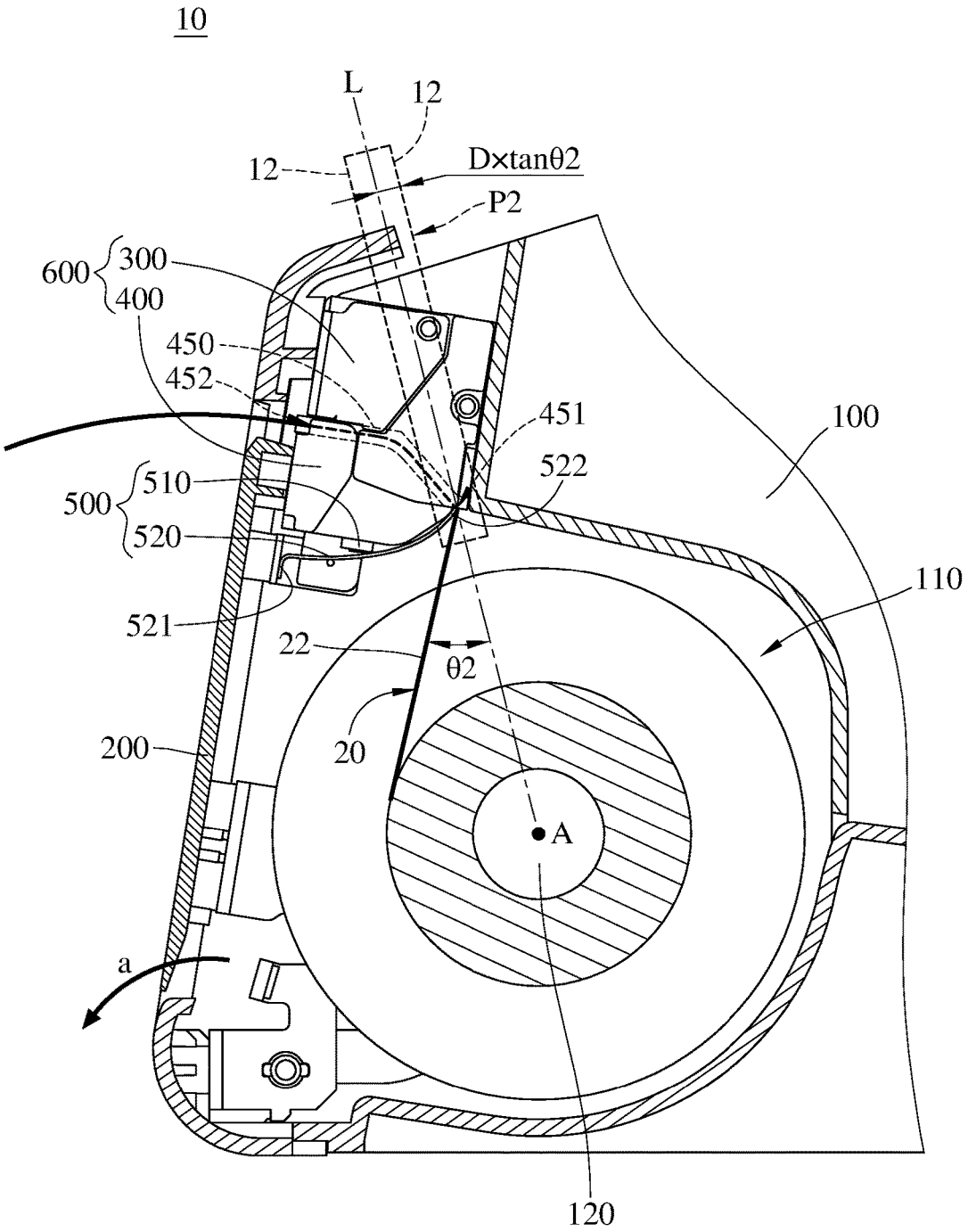
FIG. 4 is a cross-sectional view the printer having the paper roll which is used up and installed incorrectly according to the first embodiment of the disclosure.

Please refer to FIG. 1 to FIG. 4, FIG. 1 is a cross-sectional view of a printer having a paper roll which is full and installed correctly according to a first embodiment of the disclosure, FIG. 2 is a cross-sectional view of the printer having a paper roll which is used up and installed correctly according to the first embodiment of the disclosure, FIG. 3 is a cross-sectional view the printer having the paper roll which is full and installed incorrectly according to the first embodiment of the disclosure, and FIG. 4 is a cross-sectional view the printer having the paper roll which is used up and installed incorrectly according to the first embodiment of the disclosure.

In this embodiment, a printer 10 is provided. The printer 10 is, for example, a thermal printer. A paper roll 20 is able to be installed into the printer 10. The paper roll 20 is, for example, a thermal paper roll which is formed by rolling a thermal paper sheet. The printer 10 includes a main body 100, a cover 200, a first printing set 300, a second printing set 400 and a detecting module 500.

The main body 100 has an accommodating space 110 and a shaft 120. The shaft 120 is located in the accommodating space 110 and configured for installation of the paper roll 20. The paper roll 20 is able to be inserted onto the shaft 120, that is, the paper roll 20 is able to be disposed on the shaft 120. Thus, the paper roll 20 can be placed in the accommodating space 110 by being inserted onto the shaft 120. That is, the paper roll 20 can be installed in the printer 10.

The cover 200 is pivoted to the main body 100, so the cover 200 is able to be rotated relative to the main body 100. Thus, the cover 200 is able to cover the accommodating space 110 or leave the accommodating space 110 exposed. As shown in FIG. 1, the cover 200 covers the accommodating space 110. The cover 200 is able to be rotated relative to the main body 100 in the direction of arrow a to leave the accommodating space 110 exposed (that is, the accommodating space 110 is not covered by the cover 200). When the accommodating space 110 is exposed, the paper roll 20 is able to be inserted on or detached from the shaft 120.

The first printing set 300 and the second printing set 400 together form a printing assembly 600 (not numbered). The first printing set 300 is disposed in the main body 100. The first printing set 300 includes, for example, a print head (not shown) and a driving wheel (not shown).

The second printing set 400 is disposed on the cover 200. The second printing set 400 includes, for example, a driven wheel (not shown) corresponding to the driving wheel. When the accommodating space 110 is covered by cover 200, a paper channel 450 is defined between the first printing set 300 and the second printing set 400. The paper channel 450 has a paper inlet 451 and a paper outlet 452 which are opposite to each other. The paper inlet 451 and the paper outlet 452 are connected to each other, and the paper inlet 451 of the paper channel 450 is connected to the accommodating space 110. The paper sheet of the paper roll 20 is able to enter the paper channel 450 from the paper inlet 451 and then pass through the paper outlet 452.

There are two ways to dispose the paper roll 20 on the shaft 120, one is depicted in FIG. 1 and FIG. 2, and the other is depicted in FIG. 3 and FIG. 4. From the viewpoint of FIG. 1 or FIG. 2, the paper sheet of the paper roll 20 is rolled in a clockwise direction. From the viewpoint of FIG. 3 or FIG. 4, the paper sheet of the paper roll 20 is rolled in a counterclockwise direction. In this embodiment, as shown in FIG. 1 and FIG. 2, a thermosensitive surface (not numbered) of the paper sheet of the paper roll 20 passing through the paper channel 450 faces the print head (not shown) of the first printing set 300. In contrast, as shown in FIG. 3 and FIG. 4, the thermosensitive surface does not face the print head of the first printing set 300. Accordingly, it is noted that the paper roll 20 in FIG. 1 and FIG. 2 is installed on the shaft 120 correctly, but the paper roll 20 in FIG. 3 and FIG. 4 is installed on the shaft 120 incorrectly.

In this embodiment, as shown in FIGS. 1 to 4, a reference line L simultaneously passing through the paper inlet 451 of the paper channel 450 and a shaft axis A of the shaft 120 is defined. In addition, as shown in FIG. 1 and FIG. 3, when the paper roll 20 is full, there is a section 21 of the paper sheet passing through the paper inlet 451 of the paper channel 450. There is a first paper feeding angle $\theta 1$ which is formed between the said section 21 of the paper sheet and the reference line L. Then, as shown in FIG. 2 and FIG. 4, when the paper roll 20 is used up, there is another section 22 of the paper sheet passing through the paper inlet 451 of the paper channel 450. There is a second paper feeding angle $\theta 2$ which is formed between the said another section 22 of the paper sheet and the reference line L. In this embodiment, the following condition is satisfied: $\theta 1 > \theta 2$. In this and some embodiments, the term "full" means that the paper sheet of the paper roll 20 installed in the printer 10 is not used yet, and the term "used up" means that all the usable paper sheet of the paper roll 20 had been used but only a tiny piece or a short section of unusable paper sheet is left in the printer 10. In addition, the term "unusable" means the short section of the paper sheet which is not able to be used and is not able to be pulled out of the printer 10.

The detecting module 500 includes a switch 510 and a flexible member 520. The switch 510 is disposed in the accommodating space 110. The flexible member 520 is movably located in the accommodating space 110. In detail, in this embodiment, the switch 510 is disposed on a side of the second printing set 400 which is close to the shaft 120. The flexible member 520 has a fixed section 521 and a movable section 522 which are opposite to each other. The fixed section 521 of the flexible member 520 is fixed to the cover 200 by, for example, a screwing or fastening mean for positioning the flexible member 520 in the accommodating space 110. The movable section 522 of the flexible member 520 is movably located between the paper inlet 451 and the shaft 120 and spaced apart from the paper inlet 452 with a vertical distance D. When the movable section 522 of the flexible member 520 is pressed by the paper sheet to move through a predetermined position, the switch 510 is pressed by the movable section 522. In this and some embodiments, the term "predetermined position" means the position in which the movable section 522 of the flexible member 520 is not pressed or touched by the paper sheet, or the position in which the movable section 522 is pressed or touched by the paper sheet but the movable section 522 is not in contact with the switch 510.

The detecting module 500 is able to precisely detecting the installation of the paper roll 20 whether the paper roll 20 is full or used up. In detail, as shown in FIG. 1, the movable section 522 of the flexible member 520 is not pressed or touched by the paper sheet of the paper roll 20, so the movable section 522 is not moved and not in contact with the switch 510. Then, as shown in FIG. 2, although the movable section 522 is touched by the paper sheet of the paper roll 20, the switch 510 is still not pressed by the movable section 522. That is, if the paper roll 20 is installed correctly, the movable section 522 of the flexible member 520 is always located at the predetermined position when the paper roll 20 is in use, and thus the switch 510 is not triggered.

However, as shown in FIG. 3 and FIG. 4, when the paper roll 20 is installed incorrectly, the movable section 522 of the flexible member 520 is pressed by the paper sheet of the paper roll 20 so that the movable section 522 of the flexible member 520 is forced to press against the switch 510, thereby generating a warning signal for warning the user that the paper roll 20 is installed incorrectly. Accordingly, if the paper roll 20 is installed incorrectly, the switch 510 is always be triggered by the paper sheet.

Furthermore, as shown in FIG. 2 and FIG. 4, the paper roll 20 is used up, and the movable section 522 of the flexible member 520 is located within a second detecting area P2. The second detecting area P2 has two second sides 12 which are opposite to each other. Each of the two second sides 12 is parallel to the reference line L, and a distance from the reference line L to each of the two second sides 12 is equal $D \times \tan \theta 2$. In this and some embodiments, the movable section 522 of the flexible member 520 is required to be located within the second detecting area P2 for achieving the purpose of the detecting module 500, but the present disclosure is not limited to the relatively strict requirement. Usually, the user only needs to know the installation state of the paper roll when the paper roll is full. Thus, in some other embodiments, it is acceptable for the movable section 522 of the flexible member 520 to move within a first detecting area P1 (as shown in FIG. 1 and FIG. 3). As shown in FIG. 1 and FIG. 3, the paper roll 20 is full, and the first detecting area P1 has two first sides 11 which are opposite to each other. Each of the two first sides 11 is parallel to the reference line L, and a distance from the reference line L to each of the two first sides 11 is equal to $D \times \tan \theta 1$. The first detecting area P1 is greater than the second detecting area P2, and the movable section 522 of the flexible member 520 located within the first detecting area P1 is the minimum requirement for achieving the purpose of the detecting module 500.

In addition, in this embodiment, the vertical distances between the movable section 522 of the flexible member 520 and the paper inlet 452 of the paper channel 450 are almost the same, so, in FIG. 1 or FIG. 3, the area on the left side of the first detecting area P1 is substantially the same as the area on the right side thereof, but the present disclosure is not limited thereto. In other embodiments, when the movable section 522 of the flexible member 520 is more inclined, the vertical distances between the movable section 522 and the paper inlet 452 may change in a great degree, and the area on the left side of the first detecting area P1 may be quite different from the area on the right side thereof.

In addition, a width of the flexible member 520 is greater than half of a width of the paper roll 20 so as to ensure that the paper roll 20 is able to press against the flexible member 520 when the paper roll 20 is installed incorrectly.

Figure 5:
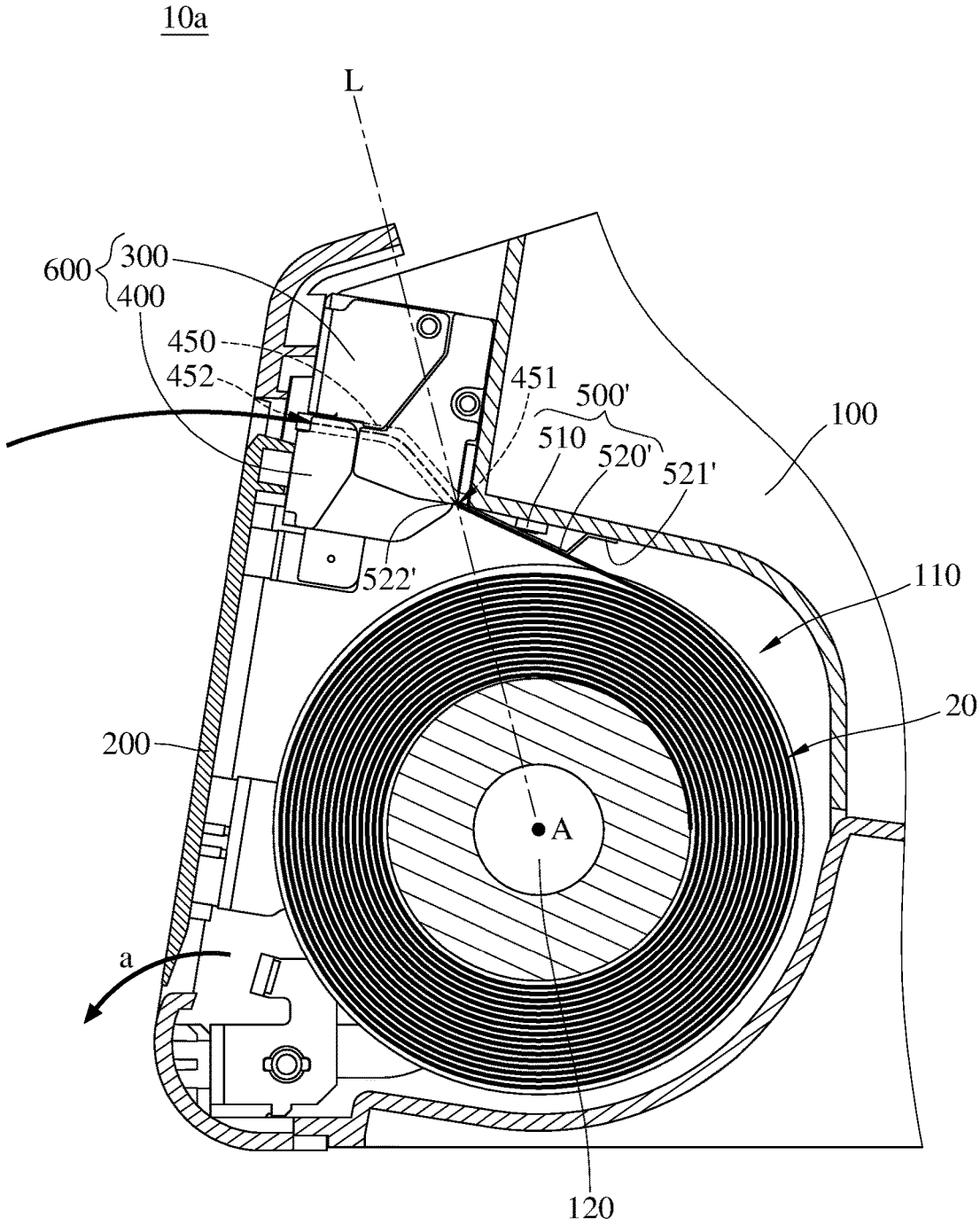
FIG. 5 is a cross-sectional view of a printer having the paper roll which is full and installed correctly according to a second embodiment of the disclosure.
Figure 6:
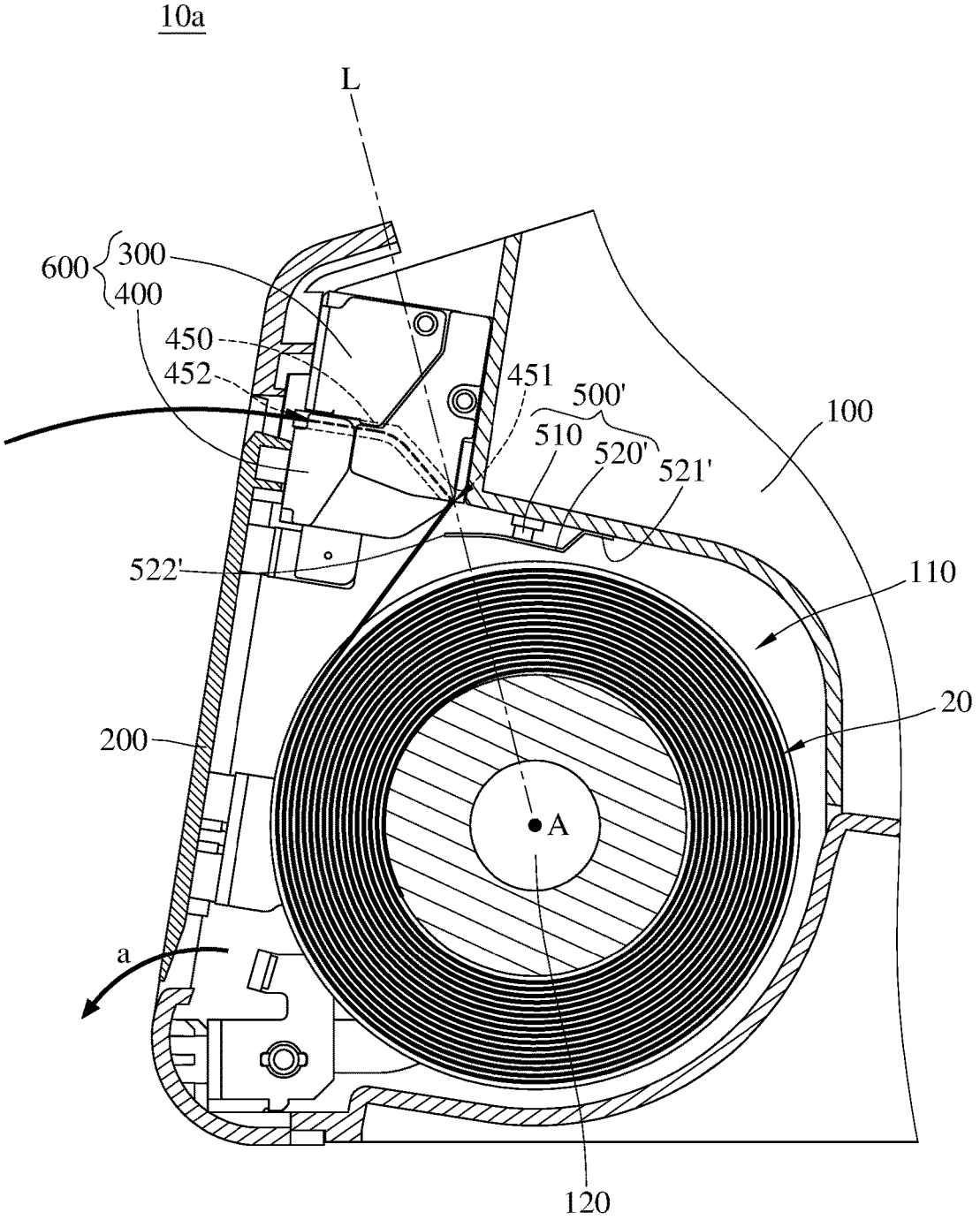
FIG. 6 is a cross-sectional view of the printer having the paper roll which is full and installed incorrectly according to the second embodiment of the disclosure.

However, the present disclosure is not limited to the positions of the switch 510 and the flexible member 520 as described in the first embodiment. Please refer to FIG. 5 and FIG. 6, FIG. 5 is a cross-sectional view of a printer having the paper roll which is full and installed correctly according to a second embodiment of the disclosure, and FIG. 6 is a cross-sectional view of the printer having the paper roll which is full and installed incorrectly according to the second embodiment of the disclosure. Since the second embodiment is similar to the first embodiment, only the differences between the two embodiments will be illustrated hereafter.

In the second embodiment, a printer 10*a* is provided. The printer 10*a* includes a flexible member 520'. The flexible member 520' has a fixed section 521' and a movable section 522' which are opposite to each other. The switch 510 is disposed on the main body 100. The flexible member 520' is fixed to the main body 100 and located between the switch 510 and the shaft 120. As shown in FIG. 5, the movable section 522' of the flexible member 520' is constantly pressed by the paper sheet of the paper roll 20. In such a case, the switch 510 is constantly pressed by the movable section 522', but the switch 510 is not triggered. Then, as shown in FIG. 6, the movable section 522' of the flexible member 520' is not pressed or touched by the paper sheet of the paper roll 20. In such a case, the switch 510 is not pressed by the movable section 522' so that the switch 510 will be triggered, thereby generating the warning signal to warn the user that the paper roll 20 is installed incorrectly.

According to the printer as discussed above, the switch of the detecting module and the flexible member are located in the accommodating space, and the movable section of the flexible member is located in the first detecting area or the second detecting area in which the paper sheet of the paper roll passes through; thus, before operating the printer, the correctness of the installation of the paper roll can be detected by the flexible member and the switch. Therefore, the printer is prevented from operating while the paper roll is installed incorrectly.

While this disclosure has been described in terms of several preferred embodiments, there are alterations, permutations, and equivalents, which fall within the scope of this disclosure. It should also be noted that there are many alternative ways of implementing the methods and apparatuses of the present disclosure. It is therefore intended that the following appended claims be interpreted as including all such alterations, permutations, and equivalents as fall within the true spirit and scope of the present disclosure.

What is claimed is:

1. A printer configured for accommodating a paper roll formed by rolling a paper sheet, the printer comprising:

a main body having an accommodating space and a shaft, the accommodating space configured for accommodating the paper roll, the shaft located in the accommodating space and configured for installation of the paper roll;

a cover pivoted to the main body for covering the accommodating space or leaving the accommodating space exposed;

a first printing set disposed in the main body;

a second printing set disposed on the cover, a paper channel defined between the first printing set and the second printing set when the cover covers the accommodating space, the paper channel having a paper inlet and a paper outlet which are opposite to each other, and the paper inlet connected to the accommodating space; and a detecting module, comprising:

a switch disposed in the accommodating space; and a flexible member having a fixed section and a movable section which are opposite to each other, the fixed section disposed close to the switch, and the movable section movably located between the paper inlet and the paper roll, wherein when the movable section is pressed by the paper sheet of the paper roll and moved toward the switch, the movable section of the flexible member presses against the switch;

wherein the paper channel is configured for the paper sheet to pass through, when the paper roll is full, a first paper feeding angle of the paper roll is $\theta 1$, when the paper roll is used up, a second paper feeding angle of the paper roll is $\theta 2$, and the following condition is satisfied: $\theta 1>\theta 2$;

wherein a vertical distance between the movable section and the paper inlet of the paper channel is D, there is a first detecting area having two first sides which are opposite to each other, each of the two first sides of the first detecting area is parallel to a reference line which is simultaneously passing through the paper inlet of the paper channel and a shaft axis of the shaft, a distance from the reference line to each of the two first sides is equal to $D\times\tan\theta 1$, when the movable section of the flexible member is not pressed by the paper sheet, the movable section is located in the first detecting area.

2. The printer according to claim 1, wherein there is a second detecting area having two second sides which are opposite to each other, each of the two first sides is parallel to the reference line, a distance from the reference line to each of the two second sides is equal to $D\times\tan\theta 2$, when the movable section of the flexible member is not pressed by the paper sheet, and the movable section of the flexible member is located in the second detecting area.

3. The printer according to claim 1, wherein the switch is disposed on the second printing set, the flexible member is fixed to the cover by the fixed section, and the flexible member is located between the switch and the shaft.

4. The printer according to claim 1, wherein the switch is disposed on the main body, the flexible member is fixed to the main body by the fixed section, and the flexible member is located between the switch and the shaft.

5. The printer according to claim 1, wherein the flexible member is positioned in the accommodating space by a screwing or fastening mean.

6. The printer according to claim 1, wherein a width of the flexible member is greater than half of a width of the paper roll.

7. The printer according to claim 1, wherein when the paper roll is full, the first paper feeding angle is formed between a section of the paper sheet passing through the paper inlet of the paper channel and the reference line.

8. The printer according to claim 1, wherein when the paper roll is used up, the second paper feeding angle is formed between a section of the paper sheet passing through the paper inlet of the paper channel and the reference line.

9. A printer for accommodating a paper roll formed by rolling a paper sheet, the printer comprising:

a main body having an accommodating space and a shaft, the accommodating space configured for accommodating the paper roll, the shaft located in the accommodating space and configured for installation of the paper roll;

a printing assembly disposed on the main body, the printing assembly having a paper channel, and the paper channel having a paper inlet and a paper outlet which are opposite and connected to each other; and a detecting module, comprising:

a switch disposed in the accommodating space and close to the printing assembly; and a flexible member having a fixed section and a movable section which are opposite to each other, the fixed section disposed in the accommodating space and close to the switch, and the movable section movably located between the paper inlet and the paper roll, wherein when the movable section is forced by a section of the paper sheet passing through the paper inlet to move through a predetermined position, the movable section of the flexible member presses against the switch so that the switch transmits a signal representing that the paper roll is disposed on the shaft correctly or incorrectly.

10. The printer according to claim 9, wherein the main body further comprises a cover, the cover is pivoted to the main body for covering the accommodating space or leaving the accommodating space exposed.

11. The printer according to claim 10, wherein the switch is disposed on a side of the printing assembly, the flexible member is fixed to the cover by the fixed section, and the flexible member is located between the switch and the shaft.

12. The printer according to claim 10, wherein the switch is disposed on the main body, the flexible member is fixed to the main body by the fixed section, and the flexible member is located between the switch and the shaft.

13. The printer according to claim 9, wherein the paper channel is configured for the paper sheet to pass through, when the paper roll is full, a first paper feeding angle of the paper roll is $\theta 1$, when the paper roll is used up, a second paper feeding angle of the paper roll is $\theta 2$, and the following condition is satisfied: $\theta 1>\theta 2$;

wherein a vertical distance between the movable section and the paper inlet of the paper channel is D, there is a first detecting area having two first sides which are opposite to each other, each of the two first sides of the first detecting area is parallel to a reference line which is simultaneously passing through the paper inlet of the paper channel and a shaft axis of the shaft, a distance from the reference line to each of the two first sides is equal to $D\times\tan\theta 1$, when the movable section of the flexible member is not pressed by the paper sheet, the movable section of the flexible member is located in the first detecting area.

14. The printer according to claim 13, wherein there is a second detecting area having two second sides which are opposite to each other, each of the two second sides is parallel to the reference line, a distance from the reference line to each of the two second sides is equal to $D\times\tan\theta 2$, when the movable section of the flexible member is not pressed by the paper sheet, the movable section of the flexible member is located in the second detecting area.

15. The printer according to claim 13, wherein when the paper roll is full, the first paper feeding angle is formed between the section of the paper sheet passing through the paper inlet of the paper channel and the reference line.

16. The printer according to claim 13, wherein when the paper roll is used up, the second paper feeding angle is formed between the section of the paper sheet passing through the paper inlet of the paper channel and the reference line.

* * * * *